US009364043B2

(12) United States Patent
Cavaliere et al.

(10) Patent No.: US 9,364,043 B2
(45) Date of Patent: Jun. 14, 2016

(54) ARTICLE OF FOOTWEAR WITH SOLE MEMBER

(71) Applicant: Nike, Inc., Beaverton, OR (US)

(72) Inventors: Sergio Cavaliere, Venice (IT); Giovanni Adami, Montebelluna (IT); Timothy J. Smith, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 134 days.

(21) Appl. No.: 13/917,096

(22) Filed: Jun. 13, 2013

(65) Prior Publication Data

US 2014/0366401 A1 Dec. 18, 2014

(51) Int. Cl.

| | |
|---|---|
| ***A43B 23/22*** | (2006.01) |
| ***A43B 13/14*** | (2006.01) |
| ***A43B 5/00*** | (2006.01) |
| ***A43B 5/02*** | (2006.01) |
| ***A43B 13/18*** | (2006.01) |

(52) U.S. Cl.

CPC . *A43B 13/14* (2013.01); *A43B 5/00* (2013.01); *A43B 5/001* (2013.01); *A43B 5/02* (2013.01); *A43B 13/141* (2013.01); *A43B 13/184* (2013.01); *A43B 23/227* (2013.01)

(58) Field of Classification Search

CPC ..... A43B 13/14; A41B 13/18; A41B 13/181–13/185; A41B 13/141

USPC ..... 36/25 R, 114, 134, 76 R, 88, 148–150, 36/107, 108

See application file for complete search history.

(56) References Cited

U.S. PATENT DOCUMENTS

| | | | | | |
|---|---|---|---|---|---|
| 1,715,165 | A | * | 5/1929 | Mansfield | A43B 23/227 36/150 |
| 2,760,279 | A | * | 8/1956 | Jones | A43B 3/103 36/11.5 |
| 3,070,907 | A | * | 1/1963 | Rocco | A43B 1/0036 36/1 |
| 3,793,751 | A | * | 2/1974 | Gordos | A43C 15/14 36/127 |
| 4,026,045 | A | * | 5/1977 | Druss | A43B 5/0417 36/100 |
| 4,331,152 | A | * | 5/1982 | Bartoli | A43B 7/00 36/150 |

(Continued)

FOREIGN PATENT DOCUMENTS

| | | | |
|---|---|---|---|
| CN | 1413090 | A | 4/2003 |
| CN | 101541200 | A | 9/2009 |

(Continued)

OTHER PUBLICATIONS

Mitchell, Walter; Young, John Radford; Imray, John (1860). Mechanical philosophy. R. Griffin and Co. p. 442.*

(Continued)

*Primary Examiner* — Robert J Hicks
*Assistant Examiner* — Jillian K Pierorazio
(74) *Attorney, Agent, or Firm* — Plumsea Law Group, LLC

(57) ABSTRACT

An article of footwear has a sole member with an exposed central torsion bar or rod connecting the heel region of the sole member to the forefoot region of the sole member. The torsion bar or rod may be supported at either end by sockets of the sole member. The torsion bar or rod may also be supported at one or more intermediate points by a hollow component. This hollow component may itself be supported by ribs extending to the medial and lateral sides of the sole member, respectively. The torsion bar or rod, the sockets, the hollow component and the ribs form a suspension structure connecting the forefoot region of the sole member to the heel region of the sole member.

29 Claims, 13 Drawing Sheets

(56) References Cited

U.S. PATENT DOCUMENTS

| | | | | |
|---|---|---|---|---|
| 4,608,970 | A | 9/1986 | Marck et al. | |
| 4,922,631 | A * | 5/1990 | Anderie | A43B 5/06 36/102 |
| 5,269,080 | A * | 12/1993 | Davis | A43C 15/14 36/114 |
| 5,497,565 | A * | 3/1996 | Balgin | A43C 15/14 36/134 |
| 5,557,865 | A * | 9/1996 | Sjosvard | A43C 15/14 36/134 |
| 8,826,571 | B2 * | 9/2014 | Rutherford | A43B 3/00 36/136 |
| 9,044,064 | B2 * | 6/2015 | Baucom | A43B 13/122 |
| 2004/0064974 | A1 * | 4/2004 | Schuster | A43B 1/0045 36/91 |
| 2005/0034328 | A1 * | 2/2005 | Geer | A43B 3/0036 36/30 R |
| 2006/0130361 | A1 * | 6/2006 | Robinson et al. | 36/25 R |
| 2007/0266598 | A1 * | 11/2007 | Pawlus | A43B 13/141 36/102 |
| 2008/0010854 | A1 * | 1/2008 | Sokolowski | A43B 5/12 36/8.3 |
| 2009/0100716 | A1 * | 4/2009 | Gerber | A43B 5/02 36/114 |
| 2009/0249648 | A1 * | 10/2009 | Brown | A43B 5/001 36/91 |
| 2010/0122472 | A1 * | 5/2010 | Wilson et al. | 36/88 |
| 2010/0122474 | A1 | 5/2010 | Wolf et al. | |
| 2011/0291506 | A1 * | 12/2011 | Post | 310/90.5 |

FOREIGN PATENT DOCUMENTS

| | | | |
|---|---|---|---|
| DE | 39 18 522 | A1 | 12/1990 |
| EP | 2944212 | A1 | 11/2015 |
| FR | 2 548 535 | A1 | 1/1985 |
| WO | 0221955 | A1 | 3/2002 |

OTHER PUBLICATIONS

Scott, Robert. Journal Bearings and Their Lubrication. Machinery lubrication. Jul. 2005.*

Teflon PTFE Fluoropolymer Resin. DuPont. Web. Retrieved Feb. 16, 2006. http://www2.dupont.com/Teflon_Industrial/en_US/products/product_by_name/teflon_ptfe/index.html.*

International Search Report and Written Opinion mailed Oct. 1, 2014 in PCT/US2014/041478.

International Preliminary Report on Patentability for PCT Application No. PCT/US2014/041478, mailed Dec. 23, 2015.

Extended European Search Report for Application No. EP15001710.1, mailed on Oct. 16, 2015, 6 pages.

Response to Office Action as filed on Dec. 4, 2015 for Chinese Patent Application No. 201480001224.2, and the English translation thereof.

First Office Action mailed Jul. 20, 2015 for Chinese Application No. 2014800012242 filed Jun. 9, 2014.

* cited by examiner

ARTICLE OF FOOTWEAR WITH SOLE MEMBER

BACKGROUND

The present embodiments relate generally to an article of footwear, and in particular to articles of footwear with ground-contacting sole members.

Articles of footwear typically have at least two major components, an upper that provides the enclosure for receiving the wearer's foot, and a sole secured to the upper. The sole may incorporate multiple layers, such as an inner sole, a midsole, and a ground-contacting sole member. The ground-contacting sole member is the primary contact to the ground or playing surface. In many types of footwear, a ground-contacting sole member includes structural components such as ground-engaging members. Examples of ground-engaging members include cleats or spikes or other protuberances that provide the wearer of the footwear with improved traction suitable to the particular athletic, work or recreational activity, or to a particular ground surface. Examples of such athletic, work or recreational footwear include baseball shoes, football shoes, rugby shoes, track shoes, golf shoes, field-hockey shoes, lacrosse shoes, hiking boots, work boots and shoes for playing Frisbee® games or touch football.

SUMMARY

In some embodiments, an article of footwear can include a sole member having a forefoot portion, a heel portion, a medial connecting portion connecting the forefoot portion to the heel portion and a lateral connecting portion connecting the forefoot portion to the heel portion. It also has a torsion bar inserted at a forefoot end to a forefoot socket in the forefoot portion of the sole member and inserted at a heel end to a heel socket in the heel portion of the sole member. The torsion bar is supported at an intermediate point between the forefoot socket and the heel socket by a hollow component. The torsion bar passes through the bore of the hollow component. In some embodiments, the torsion bar is free to rotate within the hollow component. Ribs extending from the hollow component to the medial connecting portion and lateral connecting portion of the sole member serve to support the hollow component. An upper may be attached to the sole member, thus forming an article of footwear.

In some embodiments, a sole member for an article of footwear has ground-engaging members attached to a forefoot portion of the sole member and ground-engaging members attached to a heel portion of the sole member. It has a torsion bar having an exposed intermediate portion attached at a forefoot end to a forefoot socket in the forefoot portion of the sole member and at a heel end to a heel socket in the heel portion of the sole member. It also has a hollow component positioned between the forefoot socket and the heel socket. A torsion bar passes through the bore of the hollow component. The torsion bar is free to rotate within the bore of the hollow component. The hollow component is supported by at least one rib extending from the hollow component to the sole member.

In some embodiments, an article of footwear can include a shoe upper, and a sole member attached to the upper. A torsion bar is inserted at its forward end into a forward socket in the forefoot portion of the sole member and at its rearward end into a rearward socket in a rearward portion of the sole member. A torsion bar connects the rearward portion of the sole member to the forward portion of the sole. The torsion bar passes through a hollow component that rotatably supports the torsion bar at a position between the forward end and the rearward end. The torsion bar is free to rotate within at least one of the forward socket and the rearward socket.

In some embodiments, an article of footwear can include an upper with a sole member attached to the upper. The sole member has an exposed central torsion rod passing over at least one aperture and extending from the forefoot of the sole member to the heel of the sole member. It has a forefoot socket attached to the sole member at the forefoot receiving a forefoot end of the torsion rod, and a heel socket attached to the sole member at the heel of the sole member receiving a heel end of the torsion rod. It also has a hollow component which has an inner bore positioned between the heel end of the torsion rod and the forefoot end of the torsion rod. The hollow component is support by a medial rib and by a lateral rib. The torsion bar freely rotates within the inner bore of the hollow element and within at least one of the forefoot socket and the heel socket.

In some embodiments, an article of footwear has a sole member with a torsion rod connecting a forward portion of the sole member to a rearward portion of the sole member. The forward end of the torsion rod is received by a forward socket attached to the forward portion of the sole member. The rearward end of the torsion rod is received by a rearward socket attached to the rearward portion of the sole member. The torsion rod passes through and is rotatably supported by a hollow component positioned between the forward socket and the rearward socket.

In some embodiments, the torsion bar or rod may be replaceable, such that torsion bars or rods with different characteristics may be used according to the playing conditions, the particular activity or the preferences of the wearer of the footwear.

In some embodiments, the degree of friction between the torsion bar or rod and one or more of the forefoot socket, the heel socket and/or the hollow component can be adjustable.

Other structures, objects, features and advantages of the embodiments will be apparent to one of ordinary skill in the art upon examination and study of the following detailed description and the accompanying figures. It is intended that all such additional structures, features and advantages be included within this description and this summary, be within the scope of the embodiments and be protected by the claims set forth below.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

For clarity, the detailed descriptions herein describe certain exemplary embodiments, but the disclosure herein may be applied to any article of footwear comprising certain of the features described herein and recited in the claims. In particular, although the following detailed description discusses exemplary embodiments, in the form of footwear such as baseball shoes and soccer shoes, the disclosures herein may be applied to a wide range of footwear.

Articles of footwear using a sole member fabricated according to the descriptions herein provide resistance to bending of the footwear, while providing much less resistance to twisting motions. Such articles of footwear may improve performance by allowing twisting motions necessary to a particular activity while simultaneously protecting the wearer's foot by preventing the foot from bending excessively. This optimizes the wearer's performance as he or she turns, twists, kicks, leaps and/or lands during his or her athletic or other physical activities.

Figure 1:
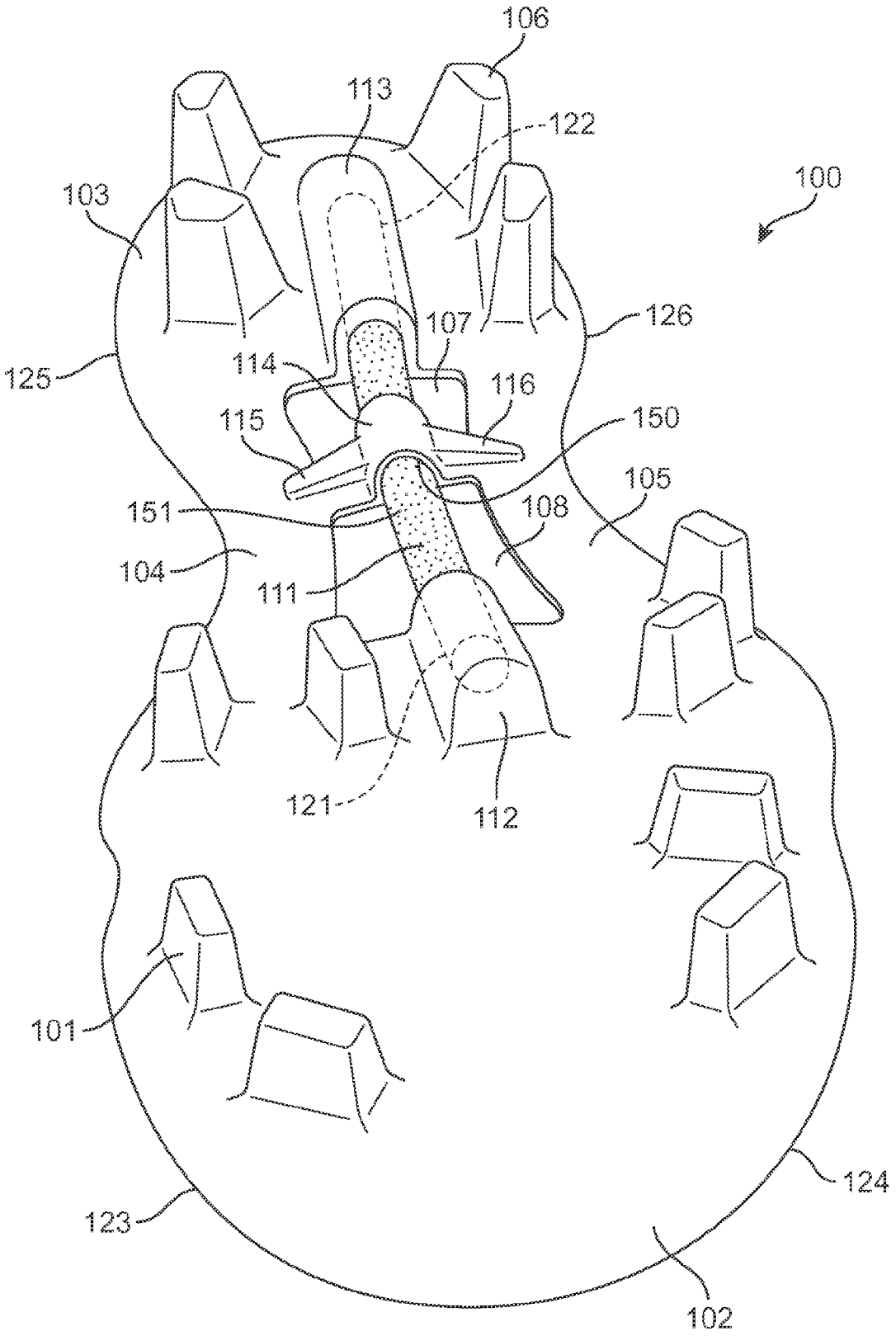
FIG. 1 is a schematic perspective front view of an embodiment of a sole member for an article of footwear.
Figure 2:
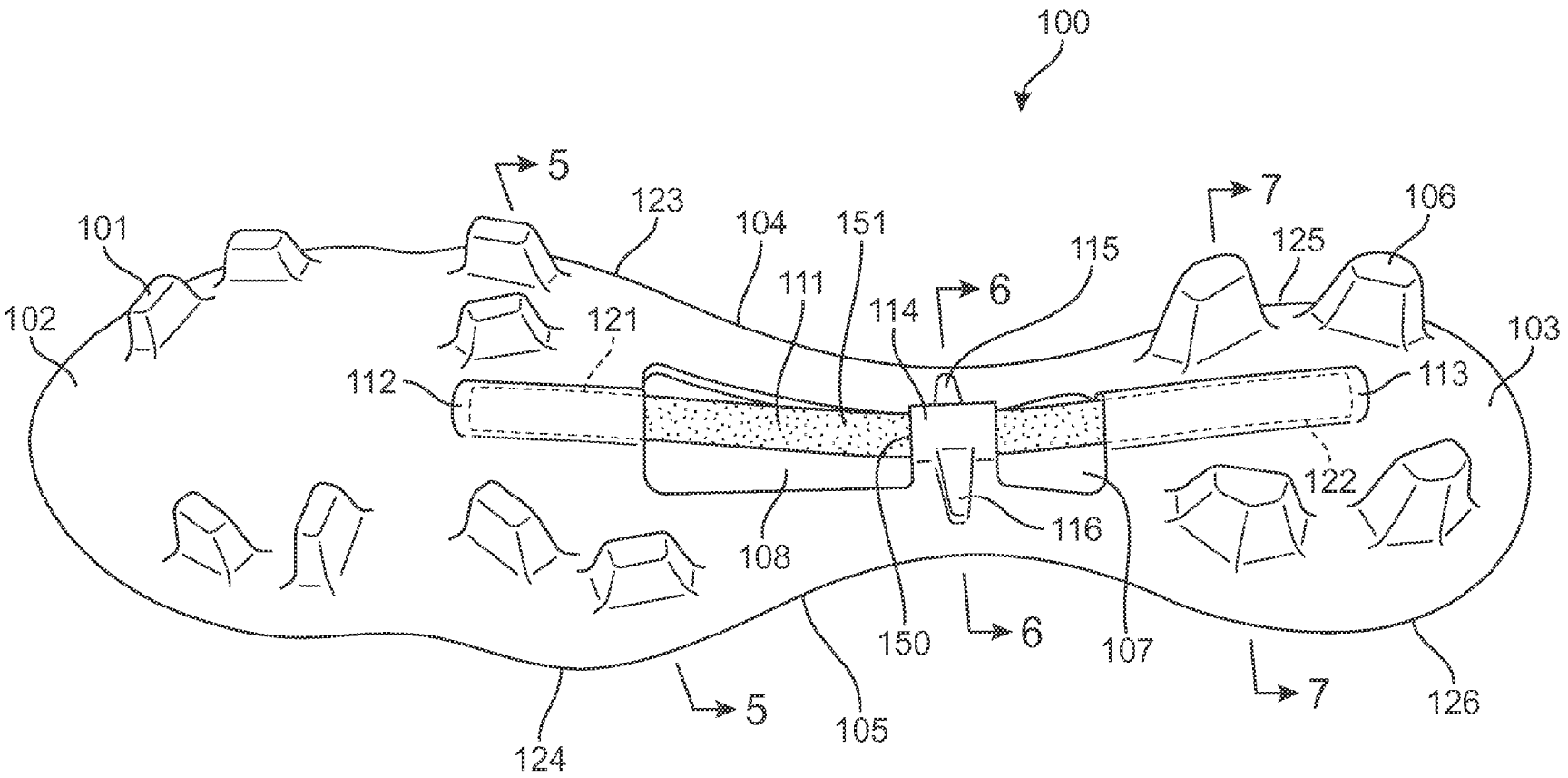
FIG. 2 is a schematic perspective side view of the sole member of FIG. 1.

FIGS. 1 and 2 are perspective views of an embodiment of a sole member 100. For purposes of illustration, sole member 100 is shown in isolation in some of the figures. However, it will be understood that sole member 100 may be part of an article of footwear. In some embodiments, for example, an article of footwear incorporating sole member 100 may further include an upper. Examples of footwear potentially including an upper and a sole member include sports shoes, recreational shoes, work shoes and boots. Still other embodiments may not include uppers. As one example, a sole member may be incorporated into a sandal, which may use straps instead of a conventional upper. Moreover, in some embodiments sole member 100 could be combined with other components (e.g., midsole or insole) of a more general sole structure. In still other embodiments, an article of footwear may include only an upper and a sole member, without any additional sole structure components.

The term "sole member" as used throughout this detailed description and in the claims is intended to describe any component, structure or member that is configured to contact a ground surface along the bottom of an article of footwear. It will therefore be understood that the term is not intended to be limited to components having particular material characteristics and/or material compositions. For example, in different embodiments the rigidity of a sole member could vary. In particular, while a sole member may be configured as substantially rigid structure, in other embodiments a sole member may be configured to bend, twist, compress, stretch or otherwise deform. The sole member could be a sole plate, an outsole, or any other type of ground-contacting component of an article of footwear.

Also, in some embodiments, sole member may have ground-engaging members such as cleats, spikes or other ground-engaging protuberances extending the bottom surface of the sole member. In other embodiments, the sole member may not have any such protuberances.

In embodiments described herein, sole member 100 may be the primary ground-contacting structure for an article of footwear. Sole member 100 may provide traction, while attenuating ground reaction forces as the footwear is pressed against the ground. Although the following detailed description of embodiments primarily describes sports shoes, other embodiments could be any article of footwear. In addition to sports shoes such as soccer shoes, baseball shoes, golf shoes, track shoes, rugby shoes, running shoes, tennis shoes, field hockey shoes and lacrosse shoes, embodiments can also include, for example, hiking boots, work boots and recreational footwear.

As shown in FIGS. 1 and 2, sole member 100 has a forefoot portion 102 and a heel portion 103. Forefoot portion 102 generally includes portions of sole member 100 that, when worn, would lie below the wearer's toes and joints connecting the metatarsals with the phalanges. Heel portion 103 generally includes portions of sole member 100 that, when worn, would lie below the rear portions of the wearer's foot, including the calcaneus bone. In addition, sole member 100 has a medial connecting portion 104 and a lateral connecting portion 105 connecting forefoot portion 102 to heel portion 103. The medial connecting portion 104 and the lateral connecting portion 105 of sole member 100 would, when the footwear is worn, lie below the arch or instep of the wearer's foot.

Although FIGS. 1 and 2 depict a sole member for a left foot, it will be understood that the embodiments described herein are applicable to articles of footwear for both left feet and right feet.

Some embodiments may include provisions to facilitate traction. In some embodiments, sole member 100 may include one or more ground engaging members. In some embodiments, sole member 100 may include forefoot ground-engaging members 101 at forefoot portion 102 and heel ground-engaging members 106 at heel portion 103, as illustrated in FIGS. 1 and 2. Forefoot ground-engaging members 101 and heel ground-engaging members 106 may provide additional traction by penetrating into the playing surface, trail surface or other ground surface. Forefoot ground engaging members 101 and heel ground-engaging member 106 may be cleats, spikes, or other structures that provide increased traction with the ground, trail or playing surface.

In addition to the embodiments described herein and shown in the figures, sole member 100 may have any number of different configurations or structures. For example, the position, number, dimensions and shapes of forefoot ground-engaging members 101 and/or heel ground-engaging members 106 could be selected according to the specific activity an article of footwear may be designed for, or according to user preferences.

In the embodiments shown in FIGS. 1 and 2, heel portion 103 is physically connected to forefoot portion 102 by medial connecting portion 104 and lateral connecting portion 105. In some embodiments, medial connecting portion 104 and lateral connecting portion 105 may be integrally formed (i.e., continuous) with heel portion 103 and forefoot portion 102. However, in other embodiments, medial connecting portion 104 and/or lateral connecting portion 105 could be separate components that are attached to forefoot portion 102 and heel portion 103 using fasteners or adhesives, as well as using any other joining methods or provisions known in the art.

The materials and dimensions of medial connecting portion 104 and lateral connecting portion 105, respectively, may be selected such that these connecting portions provide only a low resistance to any twisting of the heel portion of the footwear with respect to the forefoot portion.

Some embodiments can include additional structural features that facilitate support along portions of sole member 100. In some embodiments, sole member 100 may include a torsion bar 111. Torsion bar 111 is a generally elongated member that extends from forefoot portion 102 of sole member 100 to heel portion 103 of sole member 100. Torsion bar 111 need not have the same shape all along its length, i.e., it could have any appropriate shape at different parts of sole member 100. For example, torsion bar 111 could be rod-shaped all along its length or only along a portion of its length. In different portions, torsion bar 111 can have a round or circular cross-section, a square cross-section, a hexagonal cross-section, an octagonal cross-section, a polygonal cross-section, an oval or elliptical cross-section, a trapezoidal cross-section, an "I"-shaped cross-section or any other cross section.

The dimensions and composition of torsion bar 111 are selected to obtain the desired resistance to bending of sole member 100. For example, the cross-sectional dimensions of torsion bar 111 and the material from which it may be manufactured may be selected such that torsion bar 111 may offer a greater or lesser degree of resistance to bending of sole member 100. Torsion bar 111 may be a single unitary piece or it may be fabricated or assembled from two or more pieces. The length of torsion bar 111 may also be selected to control the specific configuration of sole member 100 as it undergoes bending.

Sole member 100 may include provisions for receiving torsion bar 111. As shown in FIGS. 1 and 2, the forefoot end 121 of torsion bar 111 is received in forefoot socket 112, which is attached to forefoot portion 102 of sole member 100. Torsion bar 111 may be fixed within forefoot socket 112, or it may be allowed to rotate within forefoot socket 112. The heel end 122 of torsion bar 111 is received in heel socket 113, which is attached to heel portion 103 of sole member 100. Torsion bar 111 may be fixed within heel socket 113 or it may be allowed to rotate within heel socket 113. Between forefoot socket 112 and heel socket 113, torsion bar 111 passes through a bore 150 in hollow component 114, such that torsion bar 111 can freely rotate within hollow component 114.

In the embodiment shown in FIGS. 1 and 2, forefoot socket 112 is generally located at roughly the midpoint laterally between medial side 123 and lateral side 124 of forefoot portion 102. Heel socket 113 is generally located at roughly the midpoint laterally between medial side 125 and lateral side 126 of heel portion 103. Thus in the embodiment of FIGS. 1 and 2, torsion bar 111 extends from forefoot socket 112 generally along the center of sole member 100 over apertures 107 and 108, passing through bore 150 in hollow component 114 to heel socket 113.

Forefoot socket 112 and heel socket 113 may be integrally formed with sole member 100, or one or both of forefoot socket 112 and heel socket 113 may be attached to sole member 100 using adhesives, screws, rivet, bolts or the like.

The configuration described above provides a torsion bar 111 that is supported at the forefoot portion by forefoot socket 112, and at the heel portion by heel socket 113. Torsion bar 111 is also supported at a point that is intermediate between the forefoot region 102 and the heel region 103 by hollow component 114. In some embodiments, the intermediate portion 151 of torsion bar 111 is exposed between forefoot socket 112 and heel socket 113, except as it passes through hollow component 114.

In an embodiment, as discussed above, hollow component 114 includes a bore 150 for receiving torsion bar 111. Bore 150 can have a circular, elliptical, polygonal or any other kind of cross-sectional shape. Hollow component 114 may also have any appropriate outer shape. For example, hollow component 114 is shown in FIGS. 1 and 2 as having a generally cylindrical outer surface. However, it may instead have a generally oblong, square, rectangular, ovoid, or other appropriately-shaped outer surface.

Torsion bar 111 may be rod-shaped along its length between forefoot socket 112 and heel socket 113, or it may have different shapes at different portions of torsion bar 111. For example, the portion of torsion bar 111 passing through bore 150 in hollow component 114 can have a cylindrical shape. In that case, the inner dimension of the cylindrical bore can be selected such that the outer diameter of that portion of torsion bar 111 fits closely and rotatably within bore 150. For example, bore 150 can be a cylindrical bore and the diameter of the cylindrical portion of bar 111 passing through bore 150 can be selected such that it fits closely within bore 150.

In some embodiments, hollow component 114 may be supported by at least one rib extending from the outer surface of hollow component 114 to sole member 100. For example, a medial rib 115 can extend from the outer surface of hollow component 114 to medial connecting portion 104, and/or a lateral rib 116 can extend from hollow component 114 to lateral connecting portion 105. In some embodiments, sole member 100 may only have either a medial connecting portion 104 or a lateral connecting portion 105. In those embodiments, hollow component 114 would have either one medial rib extending from hollow component 114 to medial connecting portion 104 or one lateral rib extending from hollow component 114 to lateral connecting portion 105.

In the embodiment illustrated in FIGS. 1 and 2, sole member 100 has two openings, including a first opening 107 and a second opening 108 on either side of hollow component 114 between heel portion 103 and forefoot portion 102. In other embodiments, such as the embodiment shown in FIG. 8 and described below, the sole member may have just one opening (such as opening 807 shown in FIG. 8) that extends from the front of the heel portion to the rear of the forefoot portion.

In the embodiment of FIG. 2, the intermediate portion 151 of torsion bar 111 is exposed between forefoot socket 112 and hollow component 114, and between hollow component 114 and heel socket 113. As discussed below, in some embodiments this exposure allows torsion bar 111 to be removed and replaced. It also provides potential wearers of the article of footwear the opportunity to inspect the torsion bar both visually and by touch when selecting an article of footwear.

In different embodiments, a torsion bar can be configured so that some portions may rotate, while other portions are rotatably fixed. Likewise, in some embodiments all portions of a torsion bar may be configured as either rotatable or non-rotatable relative to a socket or other component. In certain embodiments of the sole member illustrated in FIGS. 1 and 2, torsion bar 111 may be rotatably held within forefoot socket 112 and within hollow component 114, while being fixed within heel socket 113 in a manner that prevents rotation within heel socket 113. In other embodiments, torsion bar 111 may be rotatably held at heel socket 113 and at hollow component 114, and non-rotatably held at forefoot socket 112. In still other embodiments, torsion bar 111 may be rotatably held within forefoot socket 112, heel socket 113 and hollow component 114. Also, in other embodiments incorporating two or more hollow components, such as the embodiment shown schematically in FIG. 8 and described below, a torsion bar could be rotatably held or non-rotatably held within either or both of the hollow components.

Figure 3:
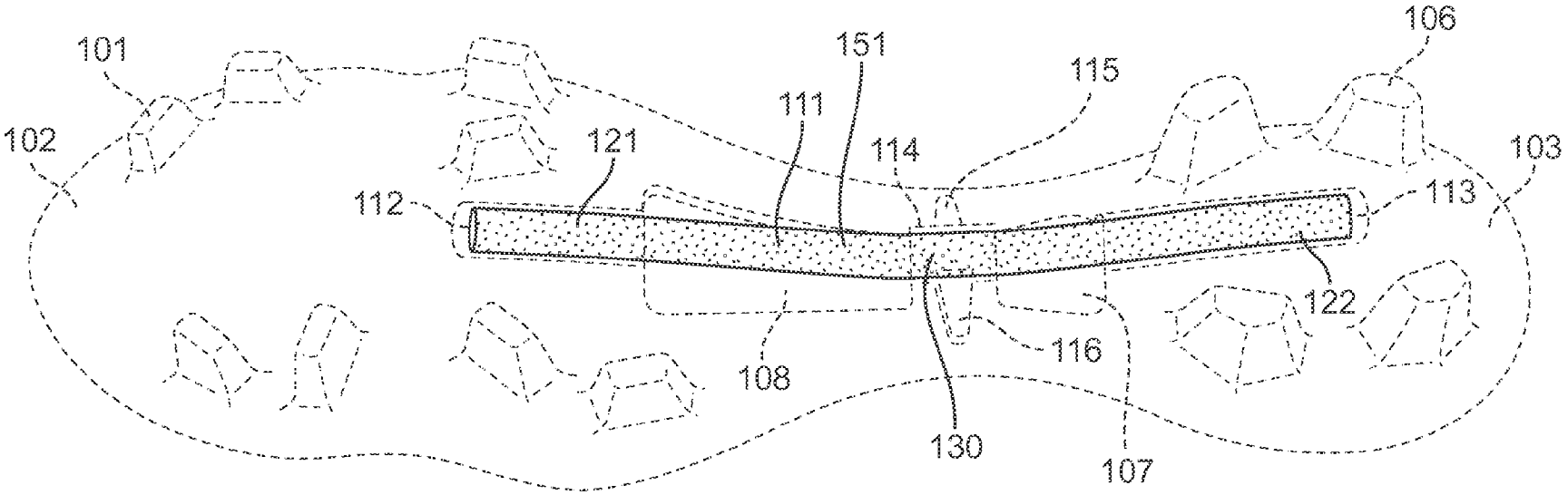
FIG. 3 is a schematic perspective view from the bottom of an embodiment of a torsion bar.
Figure 4:
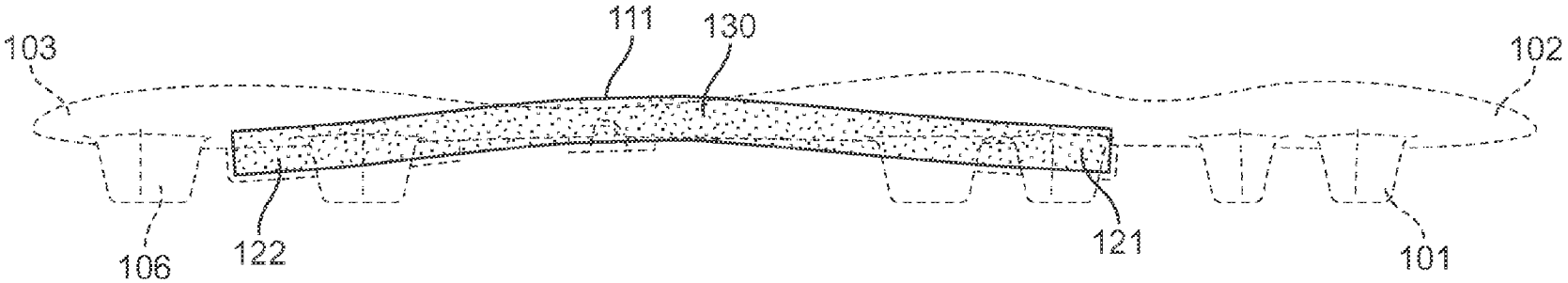
FIG. 4 is a schematic perspective view from the side of the embodiment of a torsion bar shown in FIG. 3.

FIGS. 3 and 4 are views of torsion bar 111 shown in FIGS. 1 and 2 and its supporting structures. FIG. 3 is a bottom perspective view showing forefoot end 121 of torsion bar 111 fitting into the interior of forefoot socket 112 (shown in phantom). FIG. 3 also shows heel end 122 of torsion bar 111 held in the interior of heel socket 113 (shown in phantom), and intermediate portion 151 of torsion bar 111 rotatably supported by hollow component 114 and medial rib 115 and lateral rib 116 (shown in phantom). Together with ground-engaging members 101, these structures form a suspension system for the article of footwear that provides improved traction and flexibility, while protecting the footwear from excessive bending. For example, with the ground-engaging members 101 in the forefoot portion 102 firmly implanted into the ground to provide maximum traction, torsion bar 111 allows for only a limited degree of bending, but has much smaller forces restricting any twisting of the footwear.

FIG. 4 is a side view of torsion bar 111. As clearly illustrated, in this embodiment, the portion 130 of torsion bar 111 passing under the wearer's instep has an upward curvature, i.e., when worn on the foot in normal use, it is slightly curved upwards, towards the top of sole member 100 and away from the ground. With this upward curvature, in this embodiment, torsion bar 111 supports the footwear under the wearer's instep against the heel and/or the forefoot, depending upon which one(s) are in contact with the ground.

Figure 5:
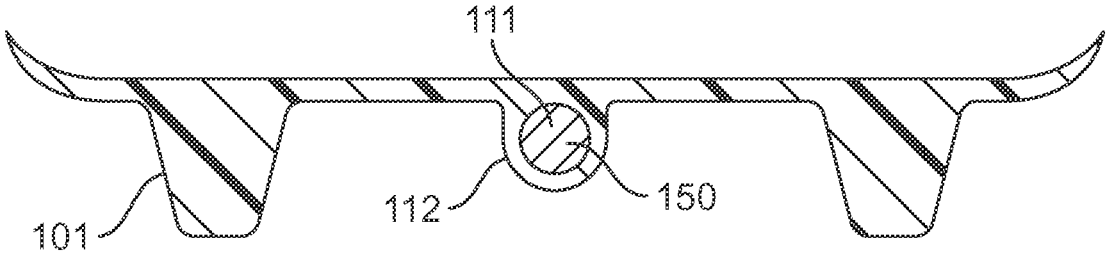
FIG. 5 shows a cross section of the sole member shown in FIG. 2, taken at line 5-5 identified in FIG. 2.
Figure 6:
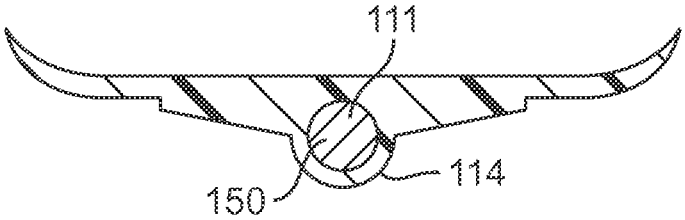
FIG. 6 shows a cross section of the sole member shown in FIG. 2, taken at like 6-6 identified in FIG. 2.
Figure 7:
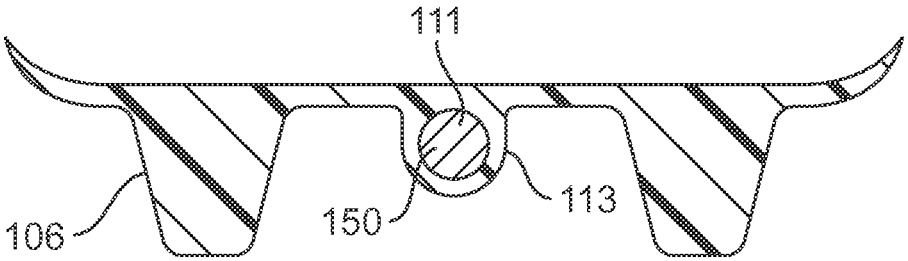
FIG. 7 shows a cross-section of the sole member shown in FIG. 2, taken at line 7-7 identified in FIG. 2.

FIGS. 5, 6 and 7 show cross-sections of sole member 100, taken at lines 5-5, 6-6 and 7-7 shown in FIG. 2, respectively, of the embodiment of FIGS. 1 and 2. These figures illustrate how forefoot ground-engaging members 101, heel ground-engaging members 106, torsion bar 111 in bore 150, forward socket 112 and heel socket 113, as well as hollow component 114 form a suspension system supporting sole member 100. In this embodiment, torsion bar 111 provides resistance to longitudinal flexing of the sole member, i.e., it provides resistance to bending of the forefoot with respect to the heel, but does not significantly limit twisting of the heel with respect to the forefoot.

Figure 8:
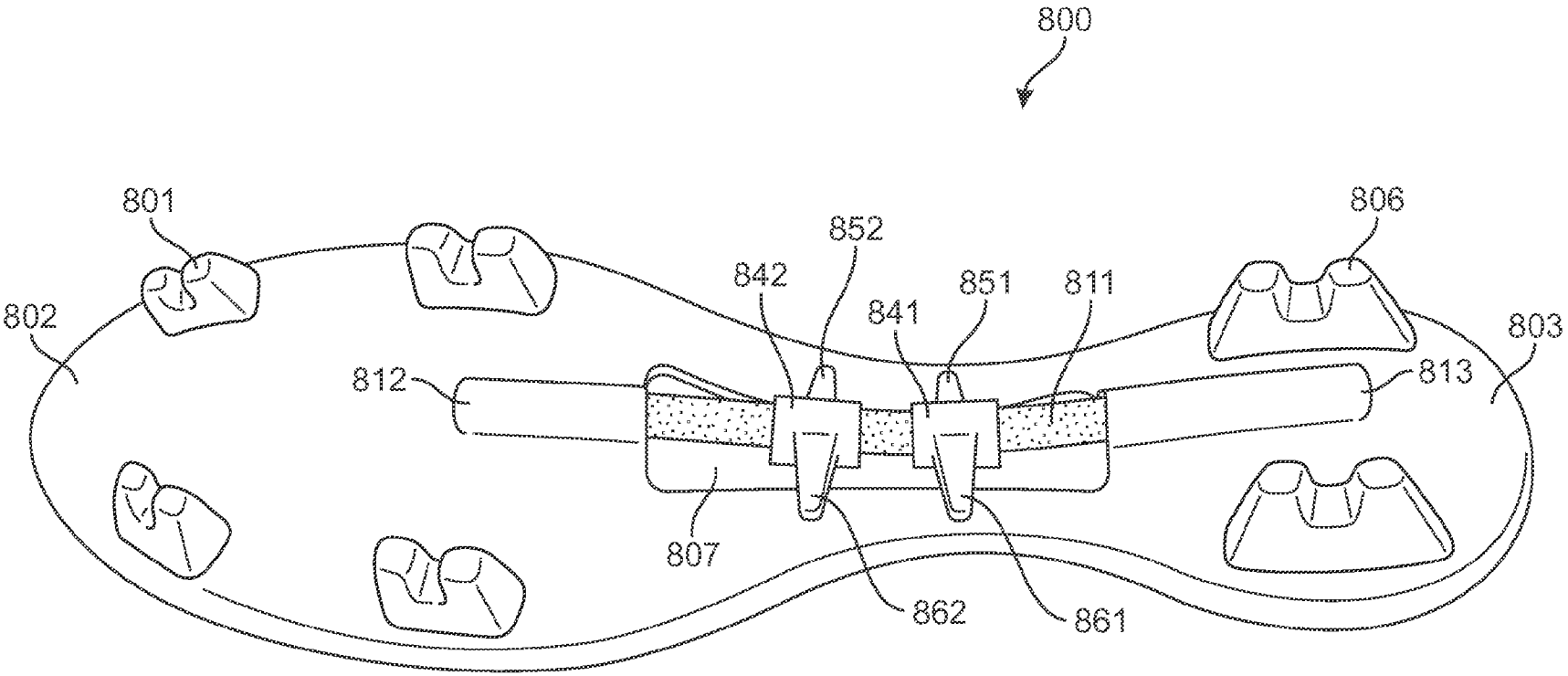
FIG. 8 is a schematic perspective side view of another embodiment of an article of footwear.

FIG. 8 is a schematic diagram illustrating another embodiment of a sole member. FIG. 8 shows ground-engaging members 801 in forefoot portion 802 of sole member 800 and ground-engaging members 806 in heel portion 803 of sole member 800. In this embodiment, torsion bar 811 is supported at either end by forefoot socket 812 and heel socket 813, respectively. Furthermore, torsion bar 811 spans opening 807 between forefoot portion 802 and heel portion 803. However, instead of having just one intermediate hollow component, the embodiment of FIG. 8 has two such components, a first hollow component 841 and a second hollow component 842, which are supported by first medial rib 851 and second medial rib 852, respectively, as well as first lateral rib 861 and second lateral rib 862, respectively. These additional components, designed according to a particular athletic, work or recreational activity, may serve to provide a different distribution of the sole member's response to bending of the footwear, while still presenting relatively minimal resistance to twisting. Other embodiments may incorporate three or more intermediate hollow components, instead of just one or two.

Figure 9:
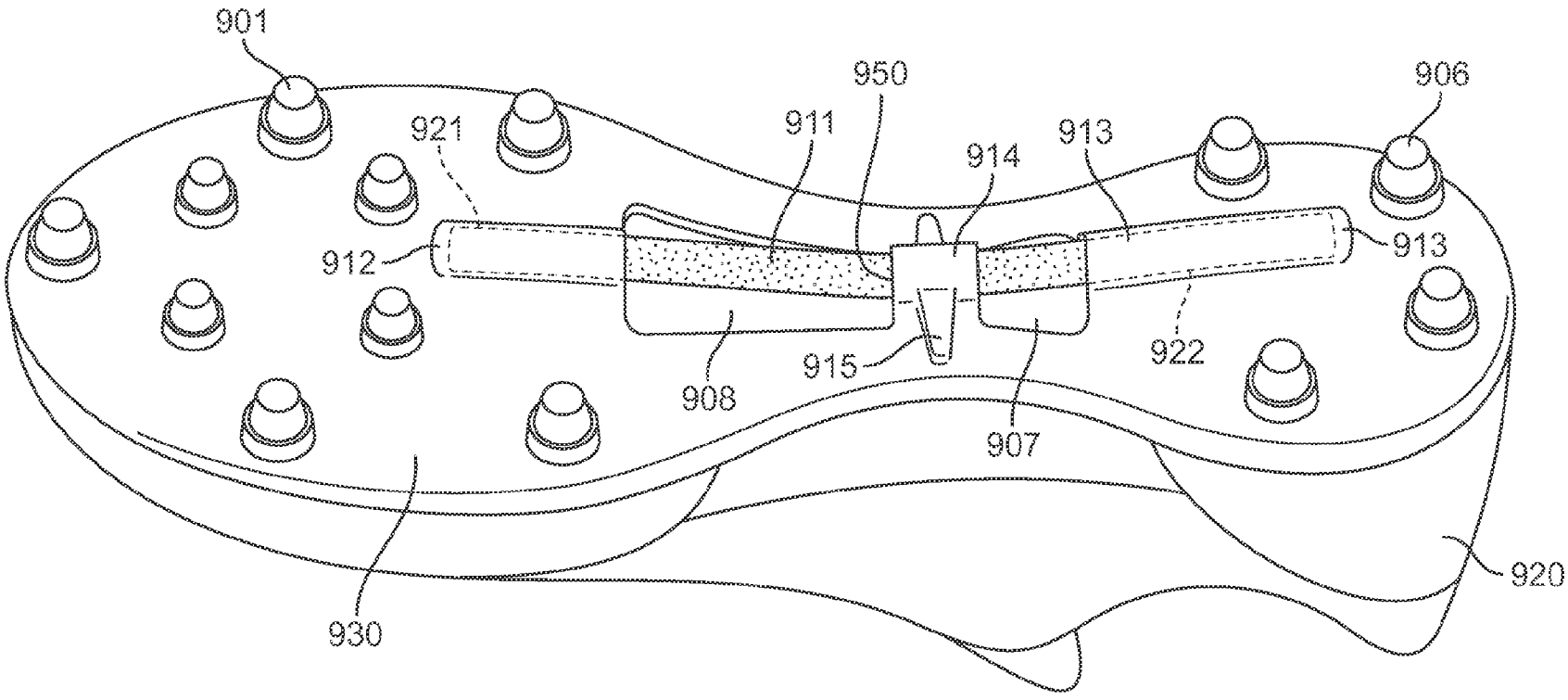
FIG. 9 is a perspective side view from the bottom of an embodiment of an athletic shoe.
Figure 10:
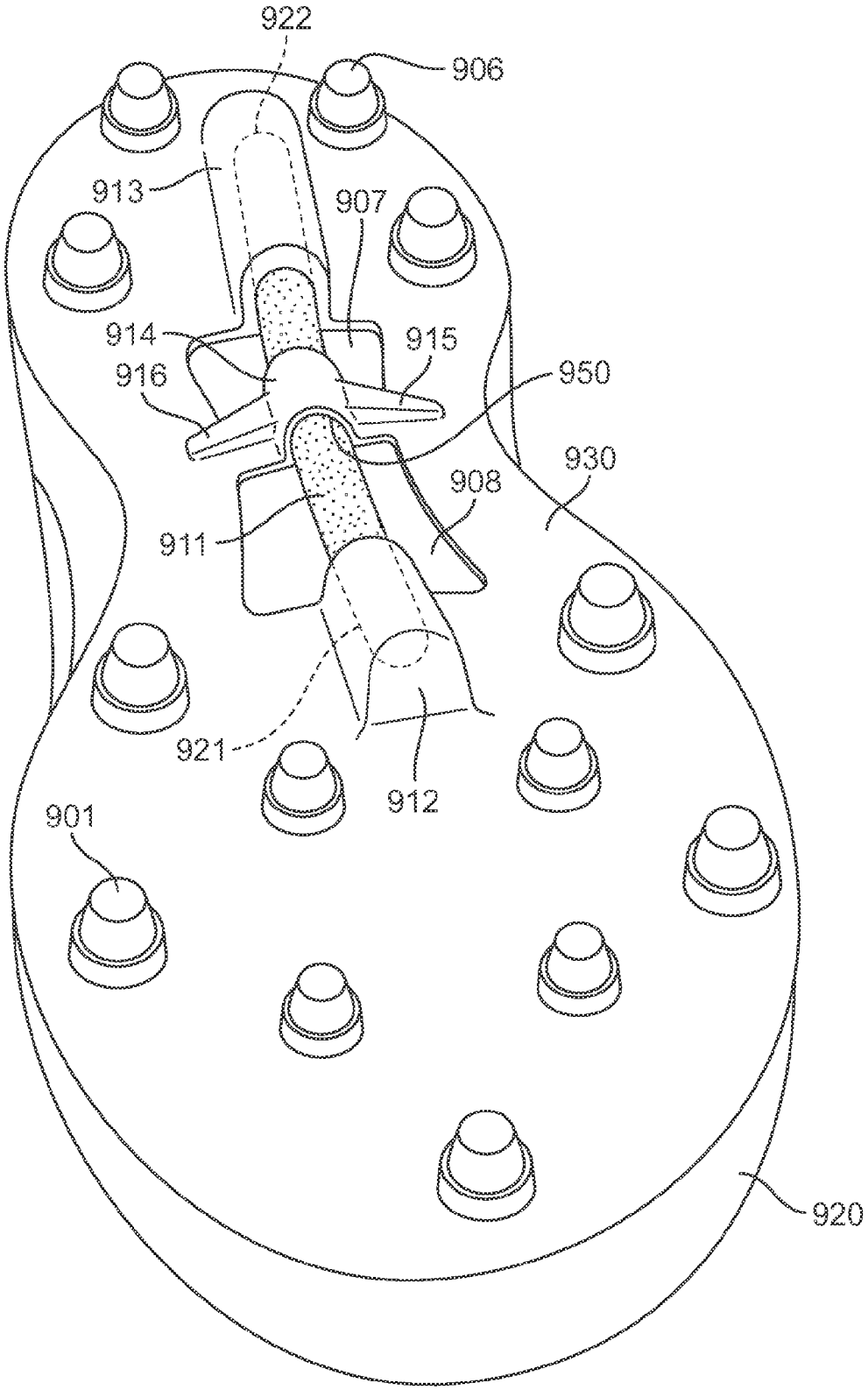
FIG. 10 is a perspective front view from the bottom of the athletic shoe shown in FIG. 9.

FIGS. 9 and 10 illustrate perspective views of an embodiment of an article of footwear 900 that includes a sole member 930 joined with an upper 920. FIG. 9 is a schematic diagram of a side perspective view from the bottom of an article of footwear 900. The article of footwear 900 shown in FIG. 9 has an upper 920 and a sole member 930. Forefoot socket 912 receives the forefoot end 921 of torsion bar 911, and heel socket 913 receives the end of heel end 922 of torsion rod 911. This figure also shows forefoot ground-engaging members 901 and heel ground-engaging members 906, which have a different configuration and positioning compared to the ground-engaging members shown in the embodiments of FIGS. 1, 2 and 8. FIG. 10 is a schematic diagram of a front perspective view from the bottom of the article of footwear shown in FIG. 9, showing upper 920, sole member 930, forefoot socket 912, heel socket 913, hollow component 914 and torsion rod 911. FIGS. 9 and 10 also show a hollow component 914, supported by medial rib 915 and lateral rib 916. In this embodiment, torsion bar 911 is a central rod that extends generally down the center of sole member 930 from forefoot socket 912 over aperture 908, through bore 950 in hollow component 914, over aperture 907 and into heel socket 913.

Figure 11:
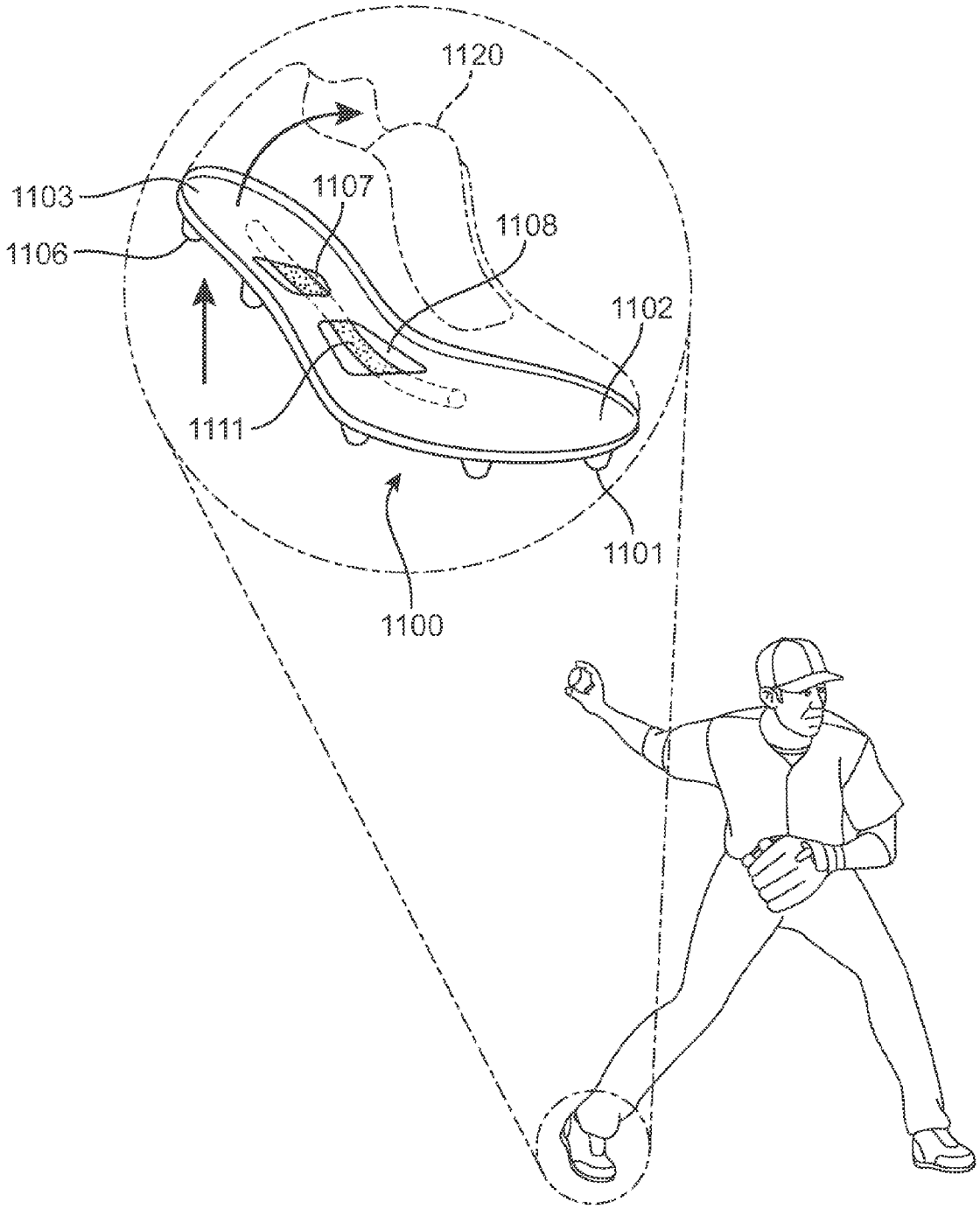
FIG. 11 is an illustration of a baseball player in the act of turning and throwing the ball.

FIG. 11 is a schematic diagram showing an example of an article of footwear in use. In this example, the wearer of the footwear may be a second baseman in the act of turning and throwing a baseball to first base. The second baseman's right foot only has the forefoot in contact with the ground. The heel of the right foot is raised slightly, and twisted, as the second baseman makes the throw. As shown in the blow-up showing sole member 1100 in action, heel portion 1103 is raised and twisting, while at least the front of forefoot portion 1102 is firmly planted, with forefoot ground-engaging members 1101 engaging the ground to prevent the footwear from slipping. The heel portion 1103 is bent upwards and twists to the side. For clarity, upper 1120 is shown in phantom. Ground-engaging members 1106 in heel portion 1103 are no longer in contact with the ground. Torsion bar 1111, seen through opening 1107 and opening 1108, provides resistance to the bending action, but less resistance to the twisting action, allowing the second baseman to complete the throw without being unnecessarily constrained by his shoe.

Although in the figures described above torsion bar 111, torsion bar 811, torsion bar 911 and torsion bar 1111 are shown as having a uniform diameter along their lengths, in other embodiments the torsion bars may have varying diameters and shapes in different portions of the sole member. In some embodiments, a torsion bar may have a circular (or oval in some examples) cross-section when it is rotatably supported within a hollow component, such as forefoot socket 112 and/or heel socket 113. Also, in embodiments in which the torsion bar is replaceable, such as in the embodiments shown in FIGS. 13 and 14 described below, the shape and dimensions of the torsion bar are such that it can readily be removed and replaced.

FIGS. 12-15 illustrate embodiments of examples of the forefoot socket or heel socket that allow for replacement of the torsion bar or rod. The torsion bar or rod may be replaced so that different bars or rods having different characteristics can be used to adapt to specific playing conditions or player preferences. For example, the torsion bar or rod could be more flexible, thus making it easier for the sole member to bend, or it could be made of stiffer materials. Also, the diameter of the portion of the torsion bar or rod within a socket could be somewhat larger, such that it resists rotation to some degree when the shoe is twisted, or it could be smaller, such that it provides much less resistance to twisting. In other embodiments, the outer surface of the torsion bar or rod or the inner surface of the forefoot socket, the heel socket and/or the hollow component may be designed to provide either greater or lesser friction when rotated within those structures. For example, a smooth surface may be selected to reduce friction, or a patterned or roughened surface may increase friction.

The materials selected for the torsion bar or rod, the forefoot socket, the heel socket and the hollow component can also be selected on the basis of cost or manufacturability, or to reduce or increase the frictional resistance to rotation. For example, polytetrafluoroethylene (PTFE or Teflon®) may be chosen because it exhibits a low coefficient of friction and has excellent wear-resistance. Nylon, high-density polyethylene (HDPE), low-density polyethylene (LDPE), polyether block amide (PEBA) and polyether ether ketone (PEEK) are examples of suitable materials that would not have coefficients of friction as low as the PTFE coefficient of friction.

Alternatively, any friction between the torsion bar and the forefoot socket, the heel socket and the hollow component(s) could be reduced by injecting a lubricant such as graphite or lubricating oil into the sockets and/or the hollow component(s).

Figure 13:
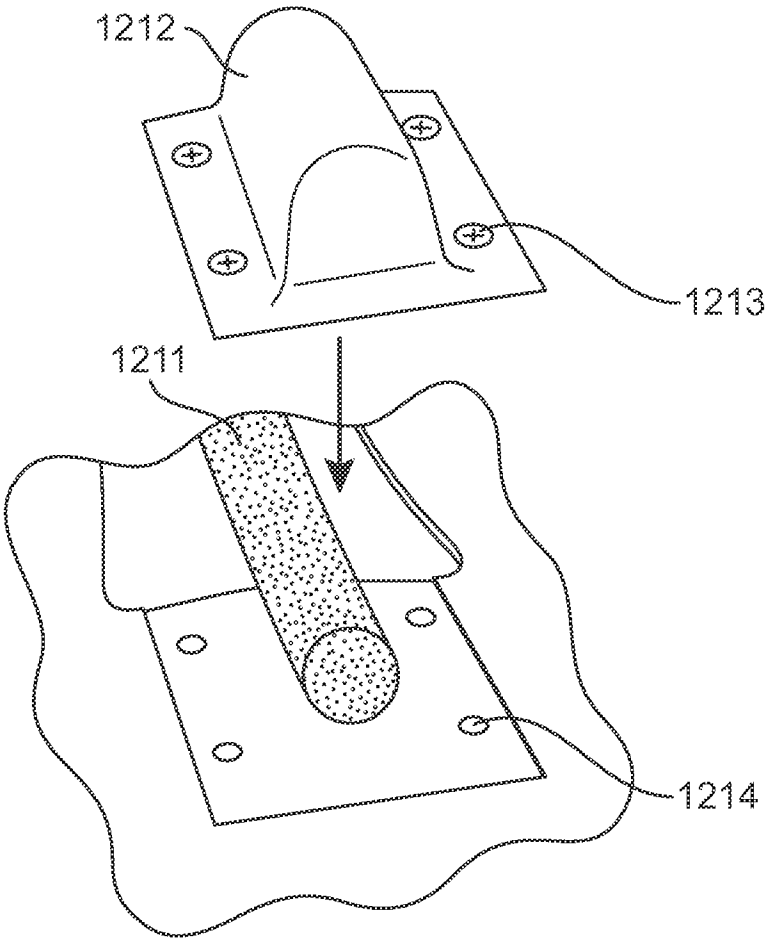
FIG. 13 is schematic diagram showing the embodiment of FIG. 12 with the top part of the forefoot socket or heel socket removed.
Figure 12:
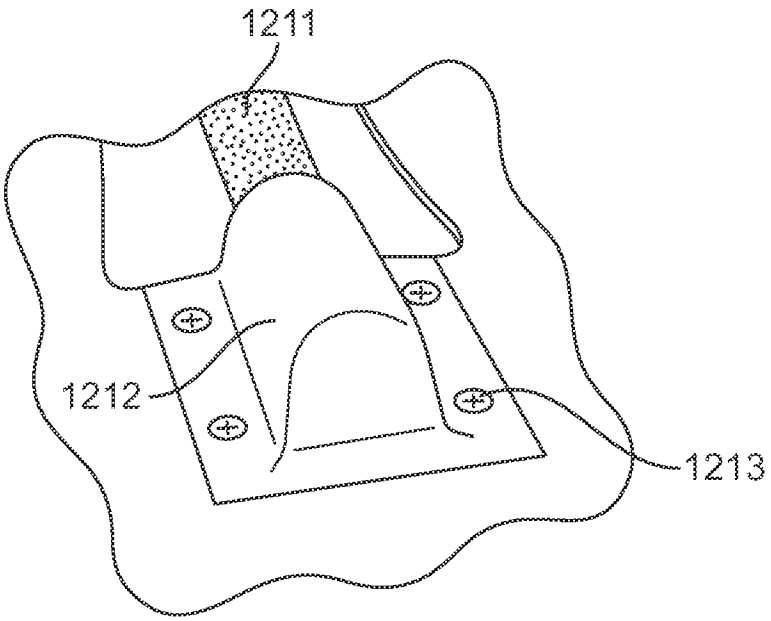
FIG. 12 is a schematic diagram showing an embodiment of a forefoot socket or heel socket that can be used with a replaceable torsion bar.
Figure 14:
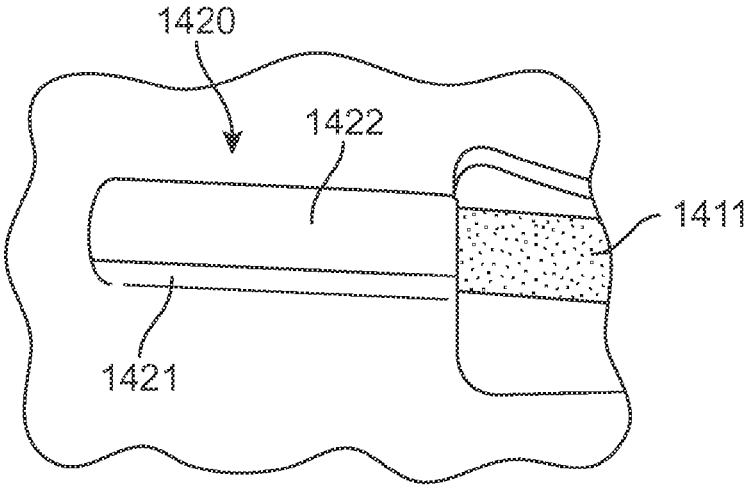
FIG. 14 is a schematic diagram of another embodiment of a forefoot socket or heel socket that can be used with a replaceable torsion bar.
Figure 15:
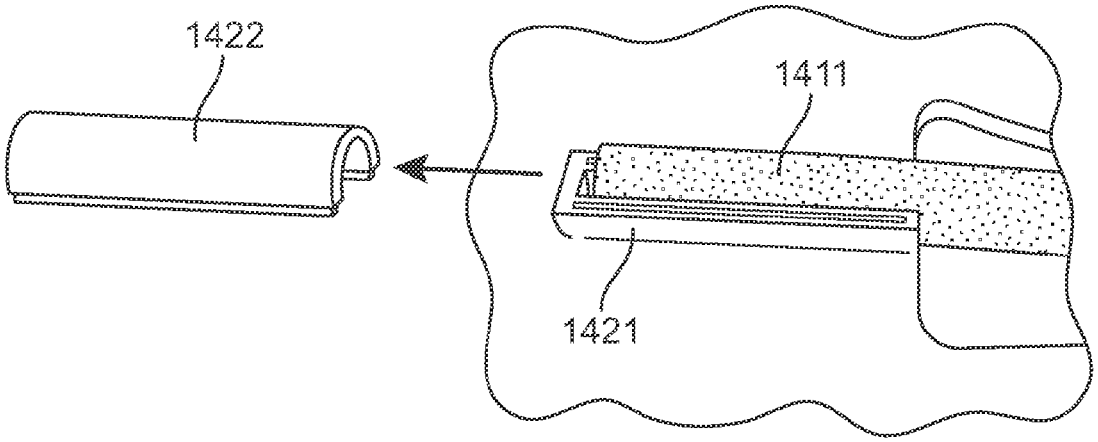
FIG. 15 is a schematic diagram showing the embodiment of FIG. 14 with the forefoot socket or the heel socket removed.

In some embodiments, the torsion bar may be removed and replaced. For example, in the embodiment of FIGS. 12 and 13, socket 1212 is held in place by screws 1213. The socket can be removed by unscrewing screws 1213 from threaded holes 1214, as shown in FIG. 13, so that torsion bar 1211 can be removed and replaced. In the embodiment shown in FIGS. 14 and 15, the socket cover 1422 of socket 1420 can slide longitudinally (forward for the forefoot socket 1420 shown in FIG. 14 and rearward for the heel socket), to allow torsion rod 1411 to be removed from the base of the socket 1421 and replaced. Still other mechanisms for having a removable and replaceable torsion bar can be implemented based upon the guidance provided herein.

Figure 16:
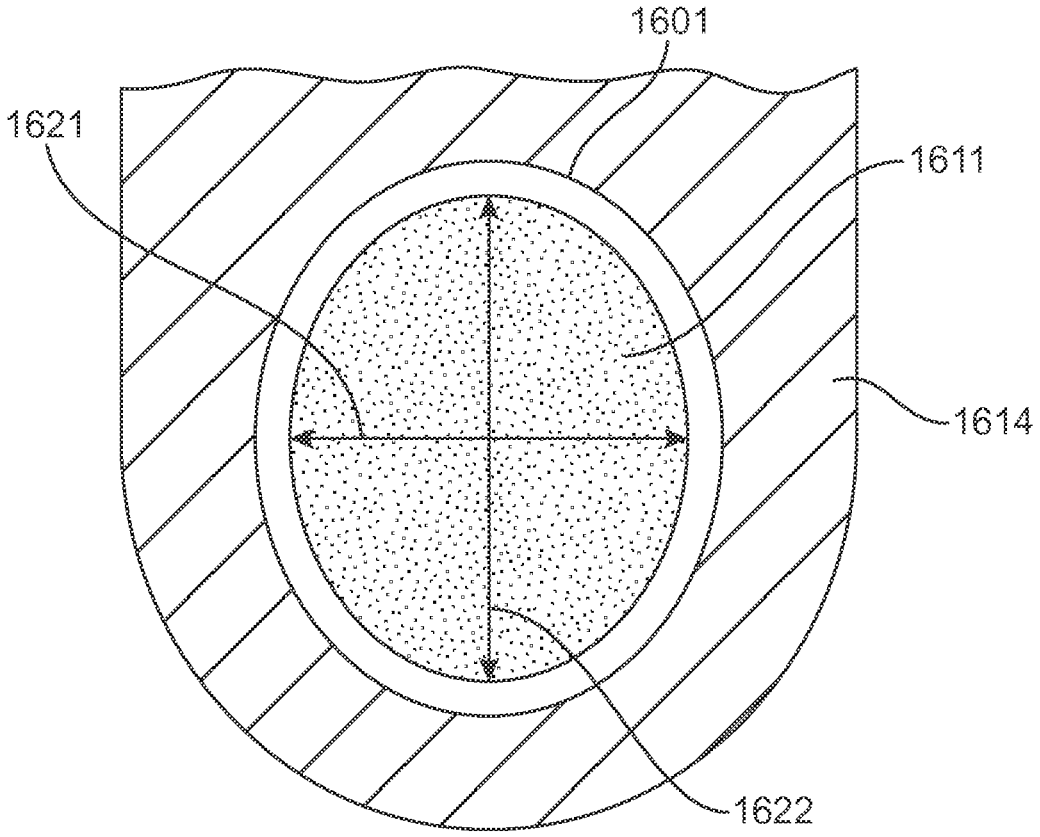
FIG. 16 illustrates an embodiment comprising a torsion bar with an elliptical cross-section within a bore with an elliptical cross-section, in which the major and minor axes of the torsion bar and bore are aligned.
Figure 17:
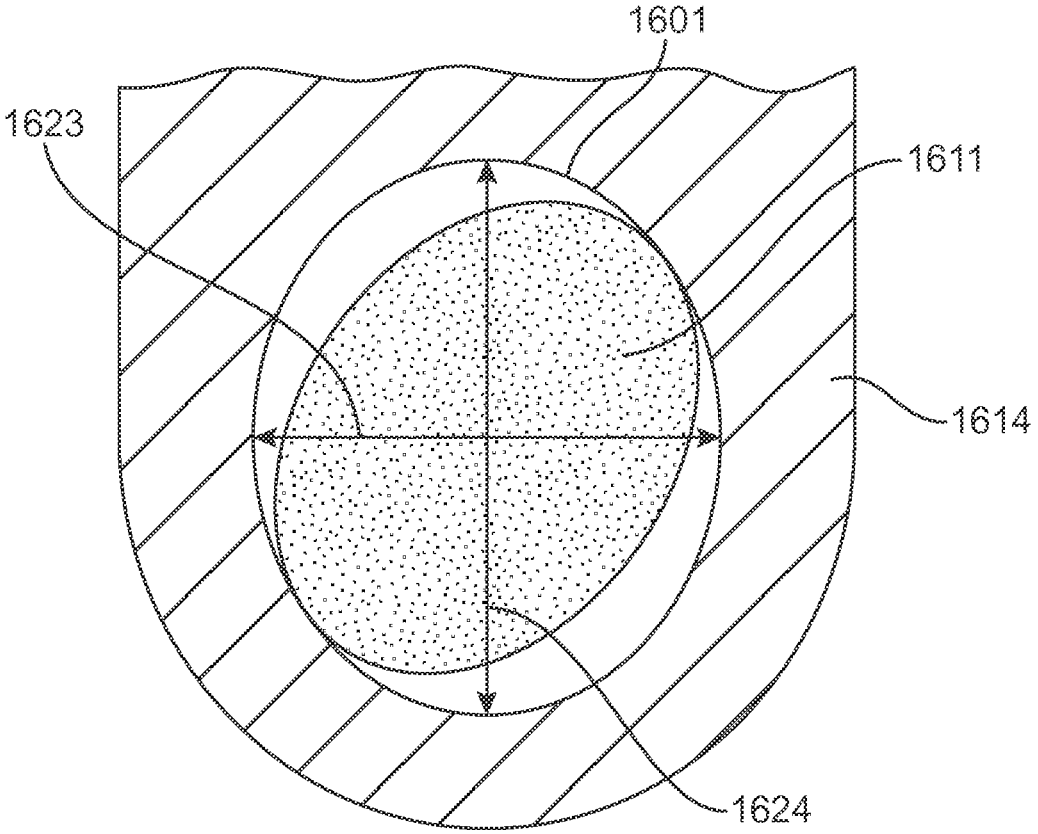
FIG. 17 illustrates an embodiment comprising a torsion bar with an elliptical cross-section within a bore with an elliptical cross-section, in which the major and minor axes of the torsion bar and bore are no longer aligned.

The resistance to twisting may also be implemented by selecting the cross-sections of the torsion bar at a bore within which the torsion bar rotates. For example, as shown in the example illustrated in FIGS. 16 and 17, hollow component 1614 may include a bore 1601 that has an oval or elliptical cross-section. (The difference in the relative dimensions of the major and minor axes of the ellipses shown in FIGS. 16 and 17 have been exaggerated for illustrative purposes.) In this embodiment, the portion of torsion bar 1611 within bore 1601 also has an oval or elliptical cross-section, dimensioned such that when the article of footwear is not undergoing a twisting motion, the torsion bar fits somewhat loosely within hollow component 1614. Specifically, the minor axis 1621 and the major axis 1622 of the ellipse defining the portion of torsion bar 1611 within bore 1601 are shorter, respectively, than the minor axis 1623 and the major axis 1624 of the ellipse defining bore 1601. However, the major axis 1622 of the ellipse defining the torsion bar portion is longer than the minor axis 1623 of the ellipse defining the bore. Thus, when the footwear is not undergoing a twisting motion, the orientation of the major axis 1624 and minor axis 1623 of the ellipse defining bore 1601 essentially match the orientation of the major axis 1622 and the minor axis 1621 of torsion bar 611, as shown in FIG. 16. When the heel of the footwear twists with respect to its forefoot, the corresponding major and minor axes no longer match. This has the effect of increasing the resistance to further twisting of the heel with respect to the forefoot beyond a predetermined angle, as shown in FIG. 17.

In yet another embodiment, the torsion rod comprises two overlapping portions held together with a bolt or pin, which can be separated from each other, removed, and replaced.

The sole member and its components such as the forefoot socket, the heel socket, the hollow component and its supporting ribs, and the torsion bar can be fabricated from durable, wear-resistant materials. For example, the sole member, the ground engaging surface and/or the structures on that surface may be fabricated from rubber, leather, polyurethane, thermoplastic polyurethane (TPU), polyether block amide (PEBA), fiber-reinforced materials, latex, nylon, carbon or glass fiber composites, para-aramid fibers, thermoplastic block amides, and thermoplastic polyester elastomers or of combinations of the foregoing. The ground engaging surface may have generally flat regions, which may be textured or relatively smooth, and may also have regions with reinforcing structures, ground-engaging members or other protuberances. These structures may be fabricated from any or all of the materials listed above, as well as from other durable materials. The overall structure may be molded as one piece, or may be assembled from different components made from different or similar materials.

While various embodiments have been described herein, the descriptions are intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear comprising:

a sole member having a forefoot portion, a heel portion, a medial connecting portion connecting the forefoot portion to the heel portion and a lateral connecting portion connecting the forefoot portion to the heel portion;

a torsion bar attached at a forefoot end to a forefoot socket in the forefoot portion of the sole member and at a heel end to a heel socket in the heel portion of the sole member;

the medial connecting portion being integrally formed with both the heel socket and the forefoot socket;

the lateral connecting portion being integrally formed with both the heel socket and the forefoot socket;

a hollow component having a bore positioned between the forefoot socket and the heel socket in a midfoot region of the sole member;

the hollow component being spaced from the forefoot socket such that a first aperture extends between the forefoot socket and the hollow component;

the hollow component also being spaced from the heel socket such that a second aperture extends between the heel socket and the hollow component;

said hollow component receiving the torsion bar within the bore such that the torsion bar is free to rotate within the hollow component;

a medial rib in the midfoot region extending from the hollow component to the medial connecting portion of the sole member;

a lateral rib in the midfoot region extending from the hollow component to the lateral connecting portion of the sole member; and an upper attached to the sole member.

2. The article of footwear of claim 1, wherein the torsion bar is free to rotate within the forefoot socket.

3. The article of footwear of claim 1, wherein the torsion bar is free to rotate within the heel socket.

4. The article of footwear of claim 1, wherein the bore has one or more inner dimensions selected such that the torsion bar closely fits within the bore.

5. The article of footwear of claim 1, wherein the torsion bar is replaceable.

6. The article of footwear of claim 1, further comprising forefoot ground-engaging members attached to the forefoot portion of the sole member and heel ground-engaging members attached to the heel portion of the sole member.

7. A sole member for an article of footwear comprising:

ground-engaging members attached to a forefoot portion of the sole member and ground-engaging members attached to a heel portion of the sole member;

a torsion bar having an exposed intermediate portion attached at a forefoot end to a forefoot socket in the forefoot portion of the sole member and at a heel end to a heel socket in the heel portion of the sole member;

a medial connecting portion being integrally formed with both the heel socket and the forefoot socket;

a lateral connecting portion being integrally formed with both the heel socket and the forefoot socket;

a first hollow component having a bore positioned between the forefoot socket and the heel socket in a midfoot region of the sole member;

said first hollow component receiving the torsion bar, wherein the torsion bar is free to rotate within the bore;

the first hollow component being spaced from the forefoot socket such that a first portion of the torsion bar is exposed between the forefoot socket and the hollow component;

the first hollow component also being spaced from the heel socket such that a second portion of the torsion bar is exposed between the heel socket and the hollow component; and at least one rib in the midfoot region extending from the first hollow component to the sole member.

8. The sole member of claim 7, wherein the ground-engaging members, the torsion bar, the forefoot socket, the heel socket, the first hollow component and the ribs form an integral suspension system.

9. The sole member of claim 7, wherein the intermediate portion of the torsion bar has an upward curvature.

10. The sole member of claim 7, wherein the bore is a cylindrical bore and the torsion bar has a circular cross-section within the cylindrical bore.

11. The sole member of claim 7, further comprising a second hollow component receiving the torsion bar, wherein the second hollow component is positioned between the forefoot socket and the first hollow component.

12. The sole member of claim 7, wherein the first hollow component is supported by a medial rib extending from the first hollow component to the medial connecting portion and a lateral rib extending from the first hollow component to the lateral connecting portion.

13. The sole member of claim 7, wherein the torsion bar spans an opening between the forefoot portion of the sole member and the heel portion of the sole member.

14. An article of footwear comprising:

an upper;

a sole plate attached to the upper, said sole plate having a forward portion, a rearward portion, a medial connecting portion connecting the forward portion to the rearward portion, and a lateral connecting portion connecting the forward portion to the rearward portion;

a torsion bar inserted at its forward end into a forward socket and at its rearward end into a rearward socket;

the medial connecting portion being integrally formed with both the rearward socket and the forward socket;

the lateral connecting portion being integrally formed with both the rearward socket and the forward socket;

a hollow component comprising a bore in a midfoot region of the sole plate;

the hollow component rotatably supporting the torsion bar at a position between the forward end and the rearward end;

the hollow component being spaced from the forward socket such that a first aperture extends between the forward socket and the hollow component;

the hollow component also being spaced from the rearward socket such that a second aperture extends between the rearward socket and the hollow component;

a medial rib disposed in the midfoot region between the forward socket and the rearward socket extending from the hollow component to the medial connecting portion;

a lateral rib disposed in the midfoot region between the forward socket and the rearward socket extending from the hollow component to the lateral connecting portion;

wherein the torsion bar is free to rotate within at least one of the forward socket and the rearward socket.

15. The article of footwear of claim 14, further comprising ground-engaging members attached to the sole plate forming an integral suspension system with the torsion bar, the forward socket, the rearward socket and the hollow component.

16. The article of footwear of claim 14, further comprising at least one of a medial rib extending from the hollow component to the sole plate and a lateral rib extending from the hollow component to the sole plate.

17. The article of footwear of claim 14, configured such that a wearer of the article of footwear may modify the friction between the torsion bar and at least one of the forward socket, the rearward socket and the hollow component.

18. The article of footwear of claim 14, wherein the torsion bar is manufactured from one of polytetrafluoroethylene, nylon, high-density polyethylene, low-density polyethylene and polyether ether ketone.

19. The article of footwear of claim 14, wherein the sole plate has an opening between the forward portion and the rearward portion.

20. An article of footwear comprising:

a sole member having a forward portion, a rearward portion, a medial connecting portion connecting the forward portion to the rearward portion, and a lateral connecting portion connecting the forward portion to the rearward portion;

a torsion rod connecting the forward portion to the rearward portion;

a forward socket attached to the forward portion of the sole member receiving a forward end of the torsion rod;

a rearward socket attached to the rearward portion of the sole member receiving a rearward end of the torsion rod;

the medial connecting portion being integrally formed with both the rearward portion and the forward portion;

the lateral connecting portion being integrally formed with both the rearward portion and the forward portion; and a hollow component comprising a bore;

the hollow component being spaced from the forward socket such that a first aperture extends between the forward socket and the hollow component;

the hollow component also being spaced from the rearward socket such that a second aperture extends between the rearward socket and the hollow component;

a medial rib disposed in the midfoot region between the forward socket and the rearward socket, the medial rib extending from the hollow component to the medial connecting portion;

a lateral rib disposed in the midfoot region between the forward socket and the rearward socket, the lateral rib extending from the hollow component to the lateral connecting portion;

the torsion rod passing through the bore of the hollow component; and the hollow component rotatably supporting the torsion rod between the forward socket and the rearward socket.

21. The article of footwear of claim 20, wherein the torsion rod comprises a forward exposed portion between the forward socket and the hollow component.

22. The article of footwear of claim 21, wherein the torsion rod also comprises a second exposed portion between the hollow component and the rearward socket.

23. The article of footwear of claim 20, wherein the torsion rod is replaceable.

24. The article of footwear of claim 20, further comprising ground-engaging members attached to the sole member.

25. An article of footwear comprising:

an upper;

a sole plate attached to the upper having a forefoot portion and a heel portion;

an exposed central torsion rod passing over at least one aperture and extending from the heel portion to the forefoot portion;

a medial connecting portion being integrally formed with both the heel portion and the forefoot portion;

a lateral connecting portion being integrally formed with both the heel portion and the forefoot portion;

a forefoot socket attached to the forefoot portion of the sole plate receiving a forefoot end of the central torsion rod;

a heel socket attached to the heel portion of the sole plate receiving a heel end of the central torsion rod;

a hollow component having an inner cylindrical bore position between the heel end of the central torsion rod and the forefoot end of the central torsion rod;

the hollow component being located in a midfoot region of the sole plate;

the hollow component being spaced from the forefoot socket such that a first portion of the torsion bar is exposed between the forefoot socket and the hollow component;

the hollow component also being spaced from the heel socket such that a second portion of the torsion bar is exposed between the heel socket and the hollow component;

a medial rib in the midfoot region extending from the hollow component to the sole plate; and a lateral rib in the midfoot region extending from the hollow component to the sole plate;

wherein the central torsion rod passes through the inner cylindrical bore of the hollow component; and wherein the central torsion rod freely rotates within the inner cylindrical bore and within at least one of the forefoot socket and the heel socket.

26. The article of footwear of claim 25, wherein the central torsion rod is replaceable.

27. The article of footwear of claim 26, wherein at least one of the forefoot socket and the heel socket comprises a removable cover.

28. The article of footwear of claim 25, wherein the central torsion rod is a polytetrafluoroethylene rod.

29. The article of footwear of claim 25, further comprising a lubricant injected into at least one of the forefoot socket, the heel socket, and the hollow component.

* * * * *